US006691623B1

(12) United States Patent
Stone

(10) Patent No.: US 6,691,623 B1
(45) **Date of Patent: *Feb. 17, 2004**

(54) FRANGIBLE POWDERED IRON PROJECTILES

(75) Inventor: Jeffrey W. Stone, Elizabethtown, KY (US)

(73) Assignee: RA Brands, LLC, Madison, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/226,252

(22) Filed: Jan. 7, 1999

Related U.S. Application Data

(63) Continuation of application No. 08/908,880, filed on Aug. 8, 1997, now Pat. No. 5,917,143.

(51) Int. Cl.[7] ..... F42B 8/14

(52) U.S. Cl. ..... 102/506; 102/517; 102/529; 86/54; 75/246; 416/66

(58) Field of Search ..... 102/398, 448, 102/459, 501, 502, 506–510, 514–517, 529; 29/1.2, 1.22, 1.23; 75/246; 419/66; 86/54, 55

(56) References Cited

U.S. PATENT DOCUMENTS

| | | | | | |
|---|---|---|---|---|---|
| 2,409,307 | A | * | 10/1946 | Patch et al. | 102/516 |
| 3,349,711 | A | * | 10/1967 | Darigo et al. | 102/514 |
| 3,463,047 | A | * | 8/1969 | Germershausen | 102/529 |
| 3,785,293 | A | * | 1/1974 | Barr et al. | 102/529 |
| 3,898,933 | A | * | 8/1975 | Castera et al. | 102/529 |
| 3,935,816 | A | * | 2/1976 | Boquette, Jr. | 102/515 |
| 3,951,035 | A | * | 4/1976 | Dautzenberg et al. | 102/529 |
| 4,428,295 | A | * | 1/1984 | Urs | 102/501 |
| 4,958,572 | A | * | 9/1990 | Martel | 102/529 |
| 5,760,331 | A | * | 6/1998 | Lowden et al. | 102/506 |
| 5,917,143 | A | * | 6/1999 | Stone | 102/506 |

FOREIGN PATENT DOCUMENTS

| | | | | |
|---|---|---|---|---|
| GB | 965889 | * | 8/1964 | 102/529 |
| GB | 1091551 | * | 11/1967 | 102/529 |
| GB | 2278423 | * | 11/1994 | 102/529 |

OTHER PUBLICATIONS

Hawley, The Condensed Chemical Dictionary, p. 1016, 1981.*

* cited by examiner

*Primary Examiner*—Harold J. Tudor
(74) *Attorney, Agent, or Firm*—Huntley & Associates LLC.

(57) ABSTRACT

A frangible projectile comprising cold compacted powdered iron and a method for manufacturing is disclosed. The projectile is useful for target and training applications.

6 Claims, No Drawings

FRANGIBLE POWDERED IRON PROJECTILES

CROSS-REFERENCE TO RELATED APPLICATION

This is a Continuation of application Ser. No. 08,908,880, filed by Aug. 8, 1997 now U.S. Pat. No 5,917,143.

BACKGROUND OF THE INVENTION

This invention relates to a frangible projectile comprising cold compacted iron particles and, more specifically, to a frangible bullet for use in target and training applications.

There is a need for training ammunition that can reduce or eliminate the risk of ricochet. Frangible ammunition, which breaks into small pieces upon impact, has been used in the past to meet these needs. A frangible projectile disintegrates upon impact with no appreciable back splatter or ricochet which might injure the shooter, other persons nearby or equipment. Prior frangible projectiles have been made substantially of lead. The use of lead produces undesirable health risks from airborne and sedentary lead particles. Lead particles present a health risk to shooters and others nearby, as well as creating an environmental problem where the lead particles fall to the ground upon disintegration of the projectile.

One solution to the need for frangible, lead-free projectiles has been the use of a compacted, unsintered admixture of metal particles comprising tungsten and at least one other metal selected from the group of iron and copper, as disclosed in copending U.S. patent application Ser. No. 08/755,963, entitled "Lead-Free Frangible Projectile." However, the admixture process and the use of tungsten adds to the cost of manufacturing such projectiles.

SUMMARY OF THE INVENTION

The projectiles of the present invention satisfy the need for lead-free frangible projectiles without the expense of high cost materials and processing. The projectiles of the present invention produce a similar "feel" and mimic the ballistic properties of lead projectiles of similar caliber and size. The projectiles of the present invention are unsintered. This deviates from existing powder metal technology where the projectiles are generally sintered to increase the strength, hardness, structural integrity and other mechanical properties. By using cold compaction without sintering, the projectiles are characterized by more complete frangibility upon impact with target media. A frangible projectile is defined herein as one designed to readily break-up upon impact with a hard surface in order to minimize ricochet or spatter.

Specifically, the present invention provides a frangible projectile comprising cold compacted iron powder. In a preferred embodiment, the projectile has a jacket of metal or polymer, with copper being the most preferred jacket material.

DETAILED DESCRIPTION OF THE INVENTION

The projectiles of the present invention will be more fully understood by reference to the following description. Both the projectiles and a process for the manufacture of the projectiles will be described. Variations and modifications of both the projectiles and the process can be substituted without departing from the principles of the invention, as will be evident to those skilled in the art.

The projectiles of the present invention are comprised of cold compacted iron powder. Cold compaction is used in its customary meaning, that is, that the compaction is carried out at substantially ambient conditions, without applied heat.

In order to provide particularly good frangibility, it is preferable that the iron particles used have a specific particle size distribution prior to being cold compacted. It has been found to be particularly advantageous to have a pre-compaction particle size distribution of about from 15 to 25% by weight of particles up to about 44 $\mu$m, about from 5 to 70% by weight of particles having a particle size of about from 44 to 149 $\mu$m, and about from 5 to 15% by weight of particles having a particle size of about from 149 to 250 $\mu$m. Even more advantageous is a pre-compaction particle size distribution of about 22% by weight of particles up to about 44 $\mu$m, about 68% by weight of particles having a particle size of about from 44 to 149 $\mu$m, and about 10% by weight of particles having a particle size of about from 149 to 250 $\mu$m. The desired particle size distribution can be obtained through a variety of conventional methods, including optical measurements and sifting. The particles are also available commercially in specific particle size distributions. A representative product is commercially available as Anchorsteel 1000 B, from Hoeganes Corp.

The particle size distributions described above have been found to provide the advantage of integrity of the projectile before and during firing and frangibility upon impact with a target media. While the relationship between particle size distribution and frangibility are not fully understood, it is believed to be a function of the mechanical interlocking of the particles after the cold compaction of the iron powder.

The projectiles of the present invention are preferably provided with a jacket. The jacket material can be selected from those customarily used in the art, for example, metal or polymeric material. Metals which can be used include aluminum, copper and zinc, with copper being a preferred choice. Polymeric materials which can be used include polyethylene and polycarbonate, with a low density polyethylene material being preferred.

The projectiles of the present invention can have a variety of configurations, including shot and bullets, but are preferably formed into bullets for use with firearms. The bullets can have noses of various profiles, including round nose, soft nose, or hollow point. Either the bullet or the jacket, if so provided, can include a driving band which increases the accuracy and reduces the dispersion of the bullet.

The projectiles of the present invention can be manufactured by a process wherein the powdered iron of the desired particle sizes are admixed to provide a mixture with the desired particle size distribution. The powdered iron can also preferably be mixed with a lubricant. This lubricant aids in removing the projectiles from the mold after compaction is complete. If a lubricant is to be added, it can be added to the powdered iron admixture. A preferred lubricant is zinc stearate. Up to about 1.0% by weight of zinc stearate can be beneficially added to the powdered iron prior to compaction. About 0.5% has been found to be particularly satisfactory.

The admixture is then placed in a die which is designed to provide the desired shape of the projectile. A wide variety of projectiles can be made according to the present invention, including shot and bullets. The invention is particularly beneficial in bullet manufacture, and especially those having a generally elongated configuration in which a leading end has a smaller circumference than a trailing end.

According to the present invention, the admixture of iron powder is cold compacted at a pressure of about from 50,000 to 120,000 psi, with a pressure of about 100,000 psi being particularly preferred. Compacting at a pressure of about 100,000 psi provides the best combination of projectile integrity before and during firing and frangibility upon impact with a target. The compaction step can be performed on any mechanical press capable of providing at least about 50,000 psi pressure for a dwell time which can be infinitesimally small. Presently available machinery operates with dwell times of about from 0.05 to 1.5 seconds. Preferably, a conventional rotary dial press is used.

After the projectile is formed by cold compaction, a jacket can be formed around the projectile if so desired. Such a jacket is preferred for a number of reasons. The jacket isolates the powdered iron material of the projectile from the gun barrel, preventing erosion of the rifling of the gun barrel which might result from direct contact between the interior surface of the barrel and the powdered iron of the projectile. The jacket also helps provide additional integrity of the projectile before and during firing as well as improving the ballistics of the projectile upon firing.

In the case of metal jackets, the jacket can be applied by any number of conventional processes, including acid or cyanide electroplating, mechanical swaging, spray coating, and chemical adhesives. The preferred method is electroplating.

A variety of electroplating techniques can be used in the instant invention, as will be evident to those in the plating art. In general, the projectiles are first cleaned, generally with an acid wash, and then sealed before the final plating. The sealing can be with an impregnating silicone solution or by dipping in a solution of metal, such as copper, nickel or zinc, prior to the final plating. In typical operations, in sealing the surface with metal, copper is preferred.

In a preferred method of plating, a vacuum impregnation is performed after the acid wash. This impregnation involves infusion of the formed projectile cores in a silicone based material in a large batch type operation. The impregnation step reduces the porosity of the projectiles by filling voids at or near the surface of the projectiles. These voids can contain impurities which might cause corrosion and plate fouling. The impregnation step also provides a barrier to prevent collection of plate bath chemicals in the recesses. Such collected chemicals could leach through the plating, discoloring and changing the dimensions of the bullet.

After sealing the surface of the projectiles, they are plated with jacketing material to deposit the desired thickness of the copper or other plating metal on the projectiles. Acid copper plating is preferably used, which is faster and more environmentally friendly than alternative techniques, such as cyanide copper plating. After jacketing, the projectiles can be sized using customary techniques and fabricated into cartridges.

In addition to the protective benefits obtained by adding a jacket to the cold compacted powdered iron projectiles, the additional mass of the jacket aids in the functionality and reliability of the projectiles when used with semi-automatic and fully automatic firearms. Such firearms require that a minimal impulse be delivered to the gun slide for operation, and the mass added by a jacket (approximately 5–10% increase) provides enough mass for the use of the projectiles of the present invention with these firearms.

The invention is further illustrated by the following specific example, in which parts and percentages are by volume, unless otherwise indicated.

EXAMPLE

Iron powders were blended to provide a blend of 22% of particles having a particle size of less than 44 μm, 68% of particles having a particle size of from 44 to 149 μm, and 10% of particles having a particle size of from 149 to 250 μm by weight. The blend further comprised 0.5 weight % zinc stearate. The blend was pressed to form 9 mm small arms bullets at ambient temperature and a pressure of 100,000 psi. A copper jacket was applied to the projectiles by washing with acid, dipping in a nickel solution, and then electroplating with copper to provide an outer jacket having a thickness of 5 mils or less.

The projectiles were fabricated into cartridges with appropriate explosive charges, and tested for frangibility on firing. The bullets fractured on impact to fine iron powder of 1–2 grains or less. The copper jacketing also fractured, but with pieces large enough to identify the gun barrel from which they were fired.

I claim:

1. A lead free frangible unsintered firearm projectile consisting essentially of cold compacted iron powder.

2. A projectile of claim 1 wherein the iron powder has a particle size distribution, prior to cold compaction, of about from 15 to 25% by weight of particles up to about 44 μm, about from 5 to 70% by weight of particles having a particle size of about from 44 to 149 μm, and about from 5 to 15% by weight of particles having a particle size of about from 149 to 250 μm.

3. A projectile of claim 2 wherein the iron powder has a particle size distribution, prior to cold compaction, of about 22% by weight of particles up to about 44 μm, about 68% by weight of particles having a particle size of about from 44 to 149 μm, and about 10% by weight of particles having a particle size of about from 149 to 250 μm.

4. A process for making a lead free frangible unsintered firearm projectile consisting essentially of cold compacted iron powder, comprising the steps of:

(a) admixing powdered iron particles; and (b) cold compacting the powdered iron particles in a mold to form a projectile of a desired final configuration.

5. A process of claim 4, wherein the powdered iron particles are selected to produce a particle size distribution, prior to cold compacting, of about from 15 to 25% by weight of particles up to about 44 μm, about from 5 to 70% by weight of particles having a particle size of about from 44 to 149 μm, and about from 5 to 15% by weight of particles having a particle size of about from 149 to 250 μm.

6. A process of claim 4, wherein the powdered iron particles are selected to produce a particle size distribution, prior to cold compacting, of about 22% by weight of particles up to about 44 μm, about 68% by weight of particles having a particle size of about from 44 to 149 μm, and about 10% by weight of particles having a particle size of about from 149 to 250 μm.

* * * * *